US008336318B2

(12) United States Patent
Koyama

(10) Patent No.: US 8,336,318 B2
(45) Date of Patent: Dec. 25, 2012

(54) CRYOPUMP AND METHOD FOR DIAGNOSING THE CRYOPUMP

(75) Inventor: Tomohiro Koyama, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 717 days.

(21) Appl. No.: 12/453,504

(22) Filed: May 13, 2009

(65) Prior Publication Data

US 2009/0282842 A1 Nov. 19, 2009

(30) Foreign Application Priority Data

May 14, 2008 (JP) ..... 2008-127133

(51) Int. Cl.
*B01D 8/00* (2006.01)

(52) U.S. Cl. ..... 62/55.5; 62/56; 62/129

(58) Field of Classification Search ..... 62/55.5, 62/56, 129, 157, 172, 268, 51.1, 126; 417/901
See application file for complete search history.

(56) References Cited

U.S. PATENT DOCUMENTS

| | | | | | |
|---|---|---|---|---|---|
| 4,295,338 | A | * | 10/1981 | Welch | 62/55.5 |
| 4,438,632 | A | * | 3/1984 | Lessard et al. | 62/55.5 |
| 4,763,483 | A | * | 8/1988 | Olsen | 62/55.5 |
| 4,910,965 | A | * | 3/1990 | Lepofsky et al. | 62/55.5 |
| 4,953,359 | A | * | 9/1990 | Forth et al. | 62/55.5 |
| 5,001,903 | A | * | 3/1991 | Lessard et al. | 62/55.5 |
| 5,144,810 | A | * | 9/1992 | Nagao et al. | 62/47.1 |
| 5,154,063 | A | * | 10/1992 | Nagao et al. | 62/55.5 |
| 5,231,839 | A | * | 8/1993 | de Rijke et al. | 62/55.5 |
| 5,386,708 | A | * | 2/1995 | Kishorenath et al. | 62/55.5 |
| 5,507,153 | A | * | 4/1996 | Seto et al. | 62/133 |
| 5,582,017 | A | * | 12/1996 | Noji et al. | 62/55.5 |
| 5,855,118 | A | * | 1/1999 | Lorimer | 62/55.5 |
| 6,116,032 | A | * | 9/2000 | Mori et al. | 62/55.5 |
| 2001/0055101 | A1 | * | 12/2001 | Hayashi | 355/53 |
| 2002/0094277 | A1 | * | 7/2002 | Gaudet et al. | 417/44.1 |
| 2004/0194477 | A1 | * | 10/2004 | Gaudet et al. | 62/55.5 |
| 2005/0155358 | A1 | * | 7/2005 | Ash et al. | 62/55.5 |
| 2005/0196284 | A1 | * | 9/2005 | Gaudet et al. | 417/44.1 |
| 2006/0048522 | A1 | * | 3/2006 | Yamada | 62/6 |
| 2007/0256429 | A1 | * | 11/2007 | Fukuda | 62/55.5 |

FOREIGN PATENT DOCUMENTS

| | | | |
|---|---|---|---|
| JP | 02-011870 | A | 1/1990 |
| JP | 07-293438 | A | 11/1995 |
| JP | 2000-073949 | A | 3/2000 |

* cited by examiner

*Primary Examiner* — Mohammad Ali
(74) *Attorney, Agent, or Firm* — Rader, Fishman & Grauer PLLC

(57) ABSTRACT

A cryopump is provided with: a refrigerator that generates a cold state by a heat cycle in which an operating gas inhaled inside is expanded and discharged; a heat shield thermally connected to the refrigerator so as to be cooled to a target temperature; and a control unit that determines a command value for a heat cycle frequency such that a temperature of the heat shield follows the target temperature, and provides the command value to the refrigerator. The control unit estimates whether the refrigerator outputs a refrigerating capacity corresponding to the command value for the frequency based on a flow rate of the operating gas.

9 Claims, 4 Drawing Sheets

CRYOPUMP AND METHOD FOR DIAGNOSING THE CRYOPUMP

BACKGROUND OF THE INVENTION

1. Field of the Invention

The present invention relates to a cryopump and a method for diagnosing the cryopump.

2. Description of the Related Art

A cryopump is a vacuum pump that captures and pumps gas molecules by condensing or adsorbing molecules on a cryopanel cooled to an extremely low temperature. A cryopanel is generally used to achieve a clean vacuum environment required in a semiconductor circuit manufacturing process.

For example, Patent Document 1 describes a cryopump in which a rotational speed of an expander motor is controlled in order to maintain a temperature or a pressure at a constant value. In the cryopump, when a temperature of a cryopanel is increased by performing sputtering, etc., during its operation, the rotational speed of the expander motor falls outside the acceptable range, even when operating normally. Therefore, the cryopump outputs an alarm signal when the rotational speed of the motor falls outside the acceptable range many times in a row. When the rotational speed of the expander motor reaches the upper limit, or the rotational speed is close to the upper limit although not reaching the upper limit, before the target time T1, the cryopump also outputs an alarm signal because it is diagnosed that the cryopump should be subjected to maintenance.

[Patent Document 1] Japanese Patent Application Laid-Open No. H7-293438

However, in the aforementioned cryopump, when a process such as sputtering is performed in a vacuum chamber to be evacuated, the rotational speed of the expander motor falls outside the acceptable range both of during the normal operation and in failure; hence, failure of the cryopump cannot be detected accurately.

Further, an alarm signal is to be outputted when the rotational speed of the motor falls outside the acceptable range many times in a row, therefore there is a possibility that it may be too late when an alarm signal has been outputted. Namely, there is a fear that the cryopump needs to be repaired or replaced immediately after an alarm signal is outputted. In this case, the process currently performed in the vacuum chamber has to be halted, resulting in a failure to manufacture products as scheduled.

In determination of a maintenance timing with the use of the upper limit of the rotational speed of the expander motor, there is a fear that the maintenance timing may be erroneously determined to come even when the cryopump operates normally, because an actual rotational speed of the motor can temporarily exceed the upper limit even when the cryopump operating normally in certain processes.

SUMMARY OF THE INVENTION

Therefore, the present invention provides a cryopump and a method for diagnosing the cryopump, which allow the pump to be diagnosed in real time and with high accuracy, and which contribute to realizing a planned process schedule by providing a leeway for the maintenance.

A cryopump according to an embodiment of the present invention comprises: a refrigerator that generates a cold state by a heat cycle in which an operating gas inhaled inside is expanded and discharged; a cryopanel thermally connected to the refrigerator so as to be cooled to a target temperature; and a control unit that determines a command value for a heat cycle frequency such that a temperature of the cryopanel follows the target temperature, and provides the command value to the refrigerator. The control unit estimates whether the refrigerator outputs a refrigerating capacity corresponding to the command value for the frequency based on a flow rate of the operating gas.

According to the embodiment, it can be estimated whether the refrigerator built into the cryopump outputs the refrigerating capacity corresponding to an operation command issued to the cryopump based on the flow rate of the operating gas in the refrigerator. Therefore, when it is estimated that a refrigerating capacity is below the level corresponding to the operation command, it can be determined that the cryopump undergoes performance degradation or failure.

When it is estimated that the refrigerator does not output the refrigerating capacity corresponding to the command value for the frequency and when the command value for the frequency exceeds a reference value, the control unit may determine that the cryopump undergoes performance degradation.

The cryopump may further comprises a compressor that executes a compression cycle in which the operating gas discharged from the refrigerator is compressed to a high pressure and delivered into the refrigerator. The control unit may control a frequency of the compression cycle so as to maintain a differential pressure between a pressure of the operating gas discharged from the refrigerator and a pressure thereof delivered into the refrigerator, at a constant value; and the control unit may estimate whether the refrigerator outputs the refrigerating capacity corresponding to the command value for the heat cycle frequency based on the frequency of the compression cycle.

Another embodiment of the present invention is a vacuum evacuation system. This vacuum evacuation system comprises: a plurality of refrigerators, each of which generates a cold state by a heat cycle in which an operating gas inhaled inside is expanded and discharged; a plurality of cryopanels, each of which is thermally connected to a respective refrigerator so as to be cooled to a target temperature; a compressor that is provided in common for the plurality of refrigerators and executes a compression cycle in which the operating gas discharged from each refrigerator is compressed to a high pressure and delivered into the refrigerator; and a control unit that determines a command value for a heat cycle frequency such that a temperature of a respective cryopanel follow the target temperature and provides the value to the respective refrigerator, and that controls a frequency of the compression cycle so as to maintain a differential pressure between pressures at an inlet port and an outlet port of the compressor, at a constant value. The control unit may determine whether the command value for the heat cycle frequency issued to the respective refrigerator exceeds a reference value, and estimates a flow rate of the operating gas discharged from the compressor based on the frequency of the compression cycle. When the estimated flow rate is below a threshold value for determination, the control unit may determine that any one of the refrigerators, the command value for the frequency issued to which exceed a reference value, undergoes performance degradation.

Yet another embodiment of the present invention is a method for diagnosing a cryopump. In the cryopump an operation command is issued to a refrigerator such that a temperature of a cryopanel thermally connected to the refrigerator so as to be cooled follows a target temperature. The method includes: determining whether the operation command exceeds a reference value; estimating whether the refrigerator outputs a refrigerating capacity corresponding to the operation command; and determining, when it is determined that the operation command exceeds the reference value and it is estimated that the refrigerator does not output the refrigerating capacity corresponding to the operation command, that the cryopump undergoes performance degradation.

DETAILED DESCRIPTION OF THE INVENTION

Figure 1:
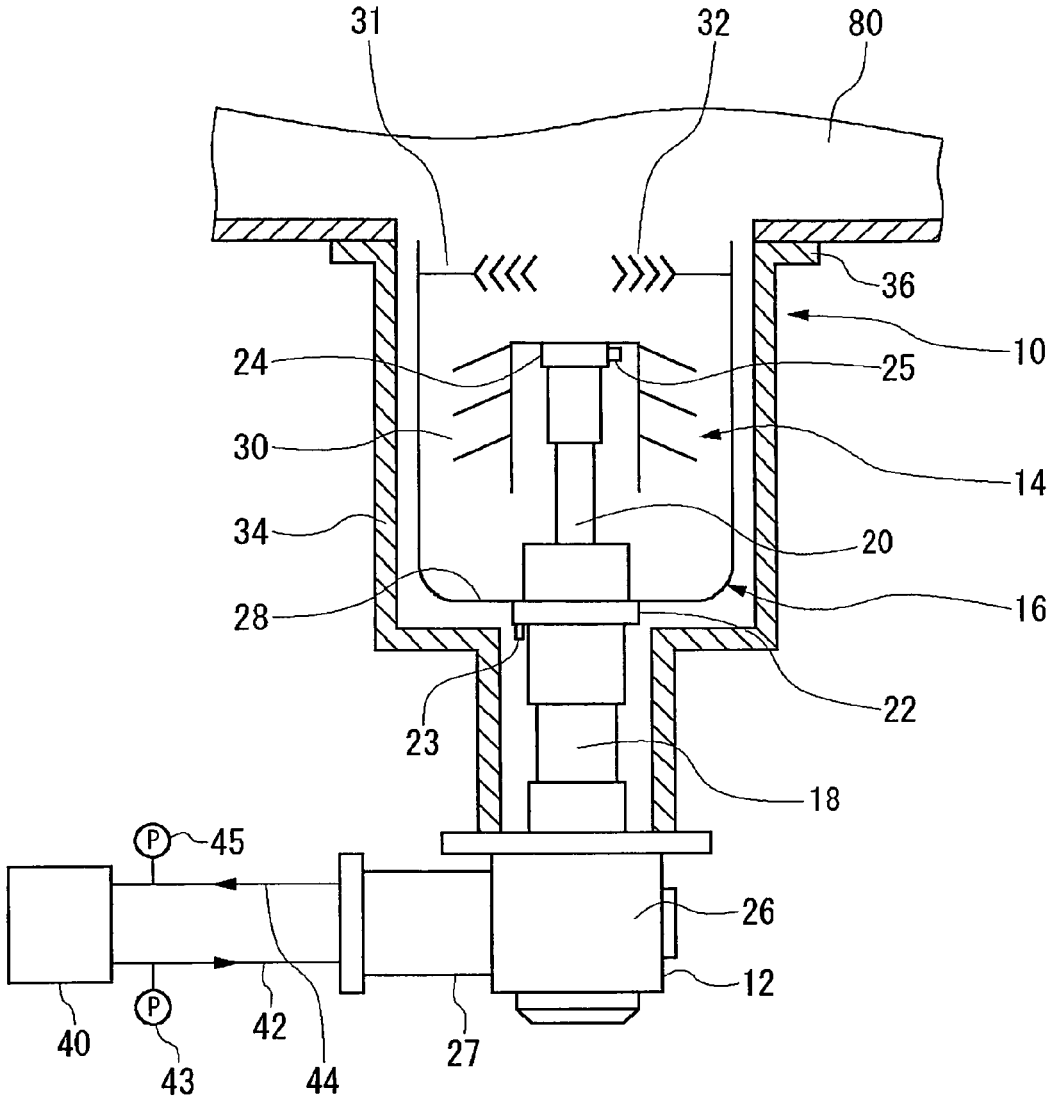
FIG. 1 is a cross-sectional view schematically illustrating the cryopump according to an embodiment of the present invention.

The present invention will now be described by reference to preferred embodiments. This does not intend to limit the scope of the invention, but to exemplify the invention. The outline of embodiments according to the invention, which are described below, will be at first described. In an embodiment, the cryopump comprises a control unit that controls a temperature of a cryopanel such that a volume of a vacuum chamber or the like, which is an evacuation target, is evacuated so as to have a target degree of vacuum. The control unit issues an operation command to a refrigerator thermally connected to the cryopanel such that a temperature of the cryopanel follows a target temperature. The refrigerator generates a cold state by a heat cycle in which an operating gas inhaled is expanded inside and discharged. The control unit takes, for example, a heat cycle frequency of the refrigerator as an operation command. In this case, the control unit determines the command value for the heat cycle frequency such that a temperature of the cryopanel follows the target temperature, and issues the command value to the refrigerator. Thereby, the refrigerator is driven in accordance with the command value for the frequency during normal operation.

In order to periodically repeat inhalation and discharge of the operating gas, the refrigerator includes a passage switching mechanism that periodically switches passages for the operating gas. The passage switching mechanism includes, for example, a valve unit and a drive unit that drives the valve unit. The valve unit is, for example, a rotary valve and the drive unit is a motor for rotating the rotary valve. The motor may be, for example, an AC motor or a DC motor. The passage switching mechanism may be a mechanism of a direct acting type, which is driven by a linear motor.

The control unit may determine a command value for a motor rotational speed rather than the command value for the heat cycle frequency. In the case of a so-called direct drive method in which a rotational output from the motor is directly transferred to the valve unit, the rotational speed of a motor is equal to the heat cycle frequency. In the case where the motor is connected to the valve unit through a power transmission mechanism including a reduction gear, etc., a certain relationship is held between the motor rotational speed and the heat cycle frequency. In this case, the control unit determines as a command value for the motor rotational speed corresponding to the heat cycle frequency required such that the temperature of the cryopanel follows the target temperature, and then issues the determined command value to the refrigerator. In the case where the refrigerator is provided with the passage switching mechanism of the direct acting type including a linear motor, the control unit determines as a command value for a reciprocating frequency of the linear motor corresponding to the heat cycle frequency required such that the temperature of the cryopanel follows the target temperature, and then issues the determined command value to the refrigerator. It is noted that, hereinafter, a rotational speed of the rotary motor and a reciprocating frequency of the linear motor are collectively referred to as an "operating frequency of a motor" in some cases, for convenience sake.

In an embodiment, the control unit estimates whether the refrigerator really outputs an expected refrigerating capacity corresponding to the operation command. The control unit estimates whether the actual refrigerating capacity is below the expected refrigerating capacity corresponding to the control command value based on the flow rate of the operating gas in the refrigerator. The control unit determines whether the cryopump undergoes performance degradation or failure by using an estimation result. If an operation command exceeding the reference value is issued to the refrigerator, the control unit may determine whether the cryopump undergoes performance degradation or failure by using the aforementioned estimation result. If it is determined that the cryopump undergoes performance degradation or failure, the control unit may output a warning that the cryopump should be subjected to maintenance or repair. Alternatively, the control unit may specify a failure mode of the cryopump by using the estimation result.

Further, the control unit may determine whether the cryopump undergoes performance degradation or failure based on an operation parameter of the refrigerator. The control unit may also determine whether the cryopump undergoes performance degradation or failure by using the operation parameter of the refrigerator in conjunction with the aforementioned estimation result. The control unit may also determine whether the cryopump undergoes performance degradation or failure based on an operation parameter, variation range or variation rate of which is larger than that of the temperature of the cryopanel. The control unit may also determine whether the cryopump undergoes performance degradation or failure based on an operation parameter, variation range or variation rate of which is permitted to be larger as compared with that permitted for the temperature of the cryopanel. The control unit may also take, for example, the command value for heat the cycle frequency of the refrigerator as an operation parameter.

The control unit may control a frequency of the compression cycle of a compressor provided associated with the refrigerator so as to maintain a differential pressure between the pressures at the inlet port and the outlet port of the compressor, at a constant value. The compressor executes a compression cycle in which the operating gas discharged from the refrigerator is compressed to a high pressure and delivered into the refrigerator. The control unit may estimate whether a refrigerating capacity of the refrigerator is below the expected refrigerating capacity corresponding to the control command value based on the compression cycle frequency. The control unit may also estimate whether an actual refrigerating capacity is below the refrigerating capacity corresponding to the control command value based on the command value data for the compression cycle frequency in real time or an measured value for the compression cycle frequency.

The control unit may determine whether the cryopump undergoes performance degradation or failure by using a parameter, of which variation during the normal cryopumping operation is incompatible with that in degradation or failure, when a load on the cryopump becomes large. Alternatively, the control unit may specify a failure mode of the cryopump by using a parameter, of which variation in a specific failure mode is different from that during the normal operation.

For example, in the aforementioned differential pressure constant control method, the compression cycle frequency becomes larger as a load on the cryopump is larger during the normal operation. In contrast, when the drive system in the cryopump undergoes performance degradation or failure, the compression cycle frequency can be smaller as a load on the cryopump is larger. When the performance of the drive system is degraded, an actual heat cycle frequency does not completely follow the command value for the heat cycle frequency even if the command value is increased in response to the increase in the load on the cryopump. As a result, the flow rate of the operating gas consumed in the refrigerator becomes relatively small, causing the compression cycle frequency to be increased little or decreased. As stated above, when the drive system in the refrigerator undergoes performance degradation or failure, the compression cycle frequency of the refrigerator can be decreased in response to the increase in the command value for the heat cycle frequency of the refrigerator. By detecting such an incompatible variation, the cryopump can be diagnosed accurately.

Hereinafter, preferred embodiments for carrying out the present invention will be further described in detail with reference to the drawings. FIG. 1 is a cross-sectional view schematically illustrating a cryopump 10 according to an embodiment of the invention.

The cryopump 10 is mounted in a vacuum chamber 80 of an apparatus, such as an ion implantation apparatus and a sputtering apparatus, that requires a high vacuum environment. The cryopump 10 is used to enhance the degree of vacuum in the vacuum chamber 80 to a level required in a requested process. For example, the cryopump 10 achieves a high degree of vacuum of about $10^{-5}$ Pa or about $10^{-8}$ Pa.

The cryopump 10 is provided with a first cryopanel cooled to a first cooling temperature level and a second cryopanel cooled to a second cooling temperature level lower than the first cooling temperature level. The first cryopanel condenses and captures a gas having a vapor pressure lower than an ambient pressure at the first cooling temperature level so as to pump the gas accordingly. For example, the first cryopanel pumps a gas having a vapor pressure lower than a reference vapor pressure (e.g., $10^{-8}$ Pa). The second cryopanel condenses and captures a gas having a vapor pressure lower than an ambient pressure at the second cooling temperature level so as to pump the gas accordingly. In order to capture a non-condensable gas that cannot be condensed at the second temperature level due to a high vapor pressure, an adsorption area is formed on the surface of the second cryopanel. The adsorption area is formed by, for example, providing an adsorbent on the panel surface. A non-condensable gas is adsorbed by the adsorption area cooled to the second temperature level and pumped.

The cryopump 10 illustrated in FIG. 1 is provided with a refrigerator 12, a panel assembly 14 and a heat shield 16. The panel assembly 14 includes a plurality of cryopanels, which are cooled by the refrigerator 12. A cryogenic temperature surface for capturing a gas by condensation or adsorption so as to pump the gas, is formed on the panel surface. The surface (e.g., rear face) of the cryopanel is normally provided with an adsorbent such as activated carbon or the like in order to adsorb a gas.

The cryopump 10 is a so-called vertical-type cryopump, where the refrigerator 12 is inserted and arranged along the axial direction of the heat shield 16. The present invention is also applicable to a so-called horizontal-type cryopump alike, where the second cooling stage of the refrigerator is inserted and arranged in the (usually orthogonal) direction intersecting with the axial direction of the heat shield 16.

The refrigerator 12 is a Gifford-McMahon refrigerator (so-called GM refrigerator). The refrigerator 12 is a two-stage refrigerator comprising a first stage cylinder 18, a second stage cylinder 20, a first cooling stage 22, a second cooling stage 24 and a refrigerator motor 26. The first stage cylinder 18 and the second stage cylinder 20 are connected in series, in which a first stage displacer and a second stage displacer (not illustrated), which are connected together, are respectively built in. A regenerator is incorporated into the first stage displacer and the second stage displacer. The refrigerator 12 may be one other than the two-stage GM refrigerator, for example, a single-stage GM refrigerator or a pulse tube refrigerator may be used.

The refrigerator motor 26 is provided at one end of the first stage cylinder 18. The refrigerator motor 26 is provided inside a motor housing 27 formed at the end portion of the first stage cylinder 18. The refrigerator motor 26 is connected to the first stage displacer and the second stage displacer such that the first stage displacer and the second stage displacer can reciprocally move inside the first stage cylinder 18 and the second stage cylinder 20, respectively. The refrigerator motor 26 is connected to a movable valve (not illustrated) provided inside the motor housing 27 such that the valve can move in the forward direction and the reverse direction The first cooling stage 22 is provided at the end portion of the first stage cylinder 18 on the second stage cylinder 20 side, i.e., at the connecting portion between the first stage cylinder 18 and the second stage cylinder 20. The second cooling stage 24 is provided at the terminal portion of the second stage cylinder 20. The first cooling stage 22 and the second cooling stage 24 are respectively fixed to the first stage cylinder 18 and the second stage cylinder 20 by, for example, brazing.

The compressor 40 is connected to the refrigerator 12 through a high pressure piping 42 and a low pressure piping 44. The high pressure piping 42 and the low pressure piping 44 are provided with a first pressure sensor 43 and a second pressure sensor 45 for measuring pressure of the operating gas, respectively. Instead of respectively providing pressure sensors in the high pressure piping 42 and the low pressure piping 44, it is possible that a differential pressure sensor, which is used for measuring a differential pressure between the high pressure piping 42 and the low pressure piping 44, is provided in a passage provided for connecting the two pipings 42 and 44 together.

The refrigerator 12 expands within it an operating gas (e.g., helium) with a high pressure supplied from the compressor 40 so as to generate a cold state at the first cooling stage 22 and the second cooling stage 24. The compressor 40 recovers the operating gas expanded inside the refrigerator 12 and repressurize the gas to supply to the refrigerator 12.

Specifically, the operating gas with a high pressure is supplied to the refrigerator 12 from the compressor 40 through the high pressure piping 42. At the time, the refrigerator motor 26 drives the movable valve inside the motor housing 27 such that the high pressure piping 42 and the inside space of the refrigerator 12 are connected to each other. When the inside space of the refrigerator 12 is filled with the operating gas with a high pressure, the inside space of the refrigerator 12 is connected to the low pressure piping 44 with the refrigerator motor 26 switching the movable valve. Thereby, the operating gas is expanded and recovered into the compressor 40. Synchronized with the operation of the movable valve, the first stage displacer and the second stage displacer reciprocally move inside the first stage cylinder 18 and the second stage cylinder 20, respectively. By repeating such heat cycles, the refrigerator 12 generates cold states in the first cooling stage 22 and the second cooling stage 24. In the compressor 40, compression cycles in which the operating gas discharged from the refrigerator 12 is compressed to a high pressure and delivered into the refrigerator 12, are repeated.

The second cooling stage 24 is cooled to a temperature lower than that of the first cooling stage 22. The second cooling stage 24 is cooled to, for example, approximately 10 K to 20 K, while the first cooling stage is cooled to, for example, approximately 80 K to 100 K. A first temperature sensor 23 is mounted in the first cooling stage 22 in order to measure a temperature thereof, and a second temperature sensor 25 is mounted in the second cooling stage 24 in order to measure a temperature thereof.

The heat shield 16 is fixed to the first cooling stage 22 of the refrigerator 12 in a thermally connected state, while the panel assembly 14 is connected to the second cooling stage 24 thereof in a thermally connected state. Thereby, the heat shield 16 is cooled to a temperature nearly equal to that of the first cooling stage 22, while the panel assembly is cooled to a temperature nearly equal to that of the second cooling stage 24.

The heat shield 16 is provided to protect the panel assembly 14 and the second cooling stage 24 from ambient radiation heat. The heat shield 16 is formed into a cylindrical shape having an opening 31 at its one end. The opening 31 is defined by the interior surface at the end of the cylindrical side face of the heat shield 16.

On the other hand, on the side opposite to the opening 31, i.e., at the other end on the pump bottom side, of the heat shield 16, an occluded portion 28 is formed. The occluded portion 28 is formed by a flange portion extending toward the inside of the radial direction at the end portion on the pump bottom side of the cylindrical side face of the heat shield 16. As the cryopump 10 illustrated in FIG. 1 is a vertical-type cryopump, the flange portion is mounted in the first cooling stage 22 of the refrigerator 12. Thereby, a cylindrically-shaped inside space 30 is formed within the heat shield 16. The refrigerator 12 protrudes into the inside space 30 along the central axis of the heat shield 16, and the second cooling stage 24 remains inserted in the inside space 30.

In the case of a horizontal-type cryopump, the occluded portion 28 is usually occluded completely. The refrigerator 12 is arranged so as to protrude into the inside space 30 along the direction orthogonal to the central axis of the heat shield 16 from the opening for attaching the refrigerator, formed on the side face of the heat shield 16. The first cooling stage 22 of the refrigerator 12 is mounted in the opening for attaching the refrigerator in the heat shield 16, while the second cooling stage 24 thereof is arranged in the inside space 30. In the second cooling stage 24, is mounted the panel assembly 14. Therefore, the panel assembly 14 is arranged in the inside space 30 of the heat shield 16. Alternatively, the panel assembly 14 may be mounted in the second cooling stage 24 through an appropriately-shaped panel mounting member.

The heat shield 16 may not be cylindrical in shape but may be a tube having a rectangular, elliptical, or any other cross section. Typically, the shape of the heat shield 16 is analogous to the shape of the interior surface of a pump case 34. The heat shield 16 may not be formed as a one-piece cylinder as illustrated. A plurality of parts may form a cylindrical shape as a whole. The plurality of parts may be provided so as to create a gap between the parts.

A baffle 32 is provided in the opening 31 of the heat shield 16. The baffle 32 is provided spaced apart from the panel assembly 14 in the direction of the central axis of the heat shield 16. The baffle 32 is mounted in the end portion on the opening 31 side of the heat shield 16, and is cooled to a temperature nearly equal to that of the heat shield 16. The baffle 32 may be formed, for example, concentrically, or into other shapes such as a lattice shape, etc., when seen from the vacuum chamber 80 side. A gate valve (not illustrated) is provided between the baffle 32 and the vacuum chamber 80. The gate valve is, for example, closed when the cryopump 10 is regenerated and opened when the vacuum chamber 80 is evacuated by the cryopump 10.

The heat shield 16, the baffle 32, the panel assembly 14, and the first cooling stage 22 and the second cooling stage 24 of the refrigerator 12, are contained inside the pump case 34. The pump case 34 is formed by connecting in series two cylinders, diameters of which are different from each other. The end portion of the cylinder with a larger diameter is opened, and a flange portion 36 for connection with the vacuum chamber 80 is formed extending toward the outside of the radial direction. The end portion of the cylinder with a smaller diameter of the pump case 34 is fixed to the motor housing 27. The cryopump 10 is fixed to an evacuation opening of the vacuum chamber 80 in an airtight manner through the flange portion 36 of the pump case 34, allowing an airtight space integrated with the inside space of the vacuum chamber 80 to be formed.

The pump case 34 and the heat shield 16 are both formed into cylindrical shapes and arranged concentrically. Because the inner diameter of the pump case 34 is slightly larger than the outer diameter of the heat shield 16, the heat shield 16 is arranged slightly spaced apart from the interior surface of the pump case 34.

Figure 2:
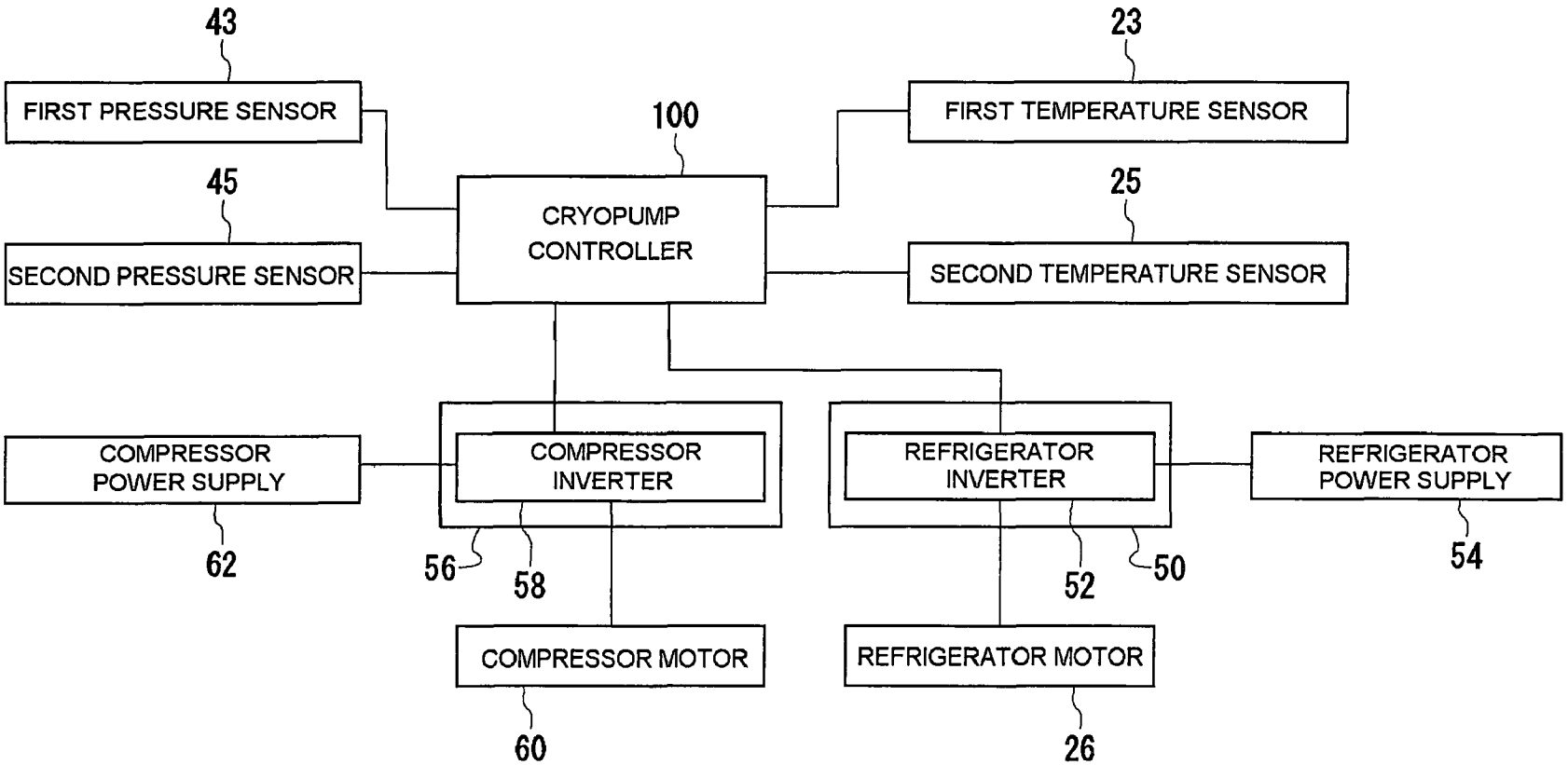
FIG. 2 is a control block diagrams with respect to the cryopump according to an embodiment of the present invention.

FIG. 2 is a control block diagrams with respect to the cryopump according to an embodiment of the present invention. A cryopump controller (hereinafter, also referred to as a CP controller) 100, which is used for controlling the cryopump 10 and the compressor 40, is provided associated with the cryopump 10. The CP controller 100 comprises: a CPU performing various arithmetic processing, a ROM storing various control programs, a RAM used as a work area for storing data and executing programs, an input/output interface, and a memory, etc. The CP controller 100 may be configured to be integrated with the cryopump 10, or configured separately from the cryopump 10 to be operable to communicate with each other.

Figure 4:
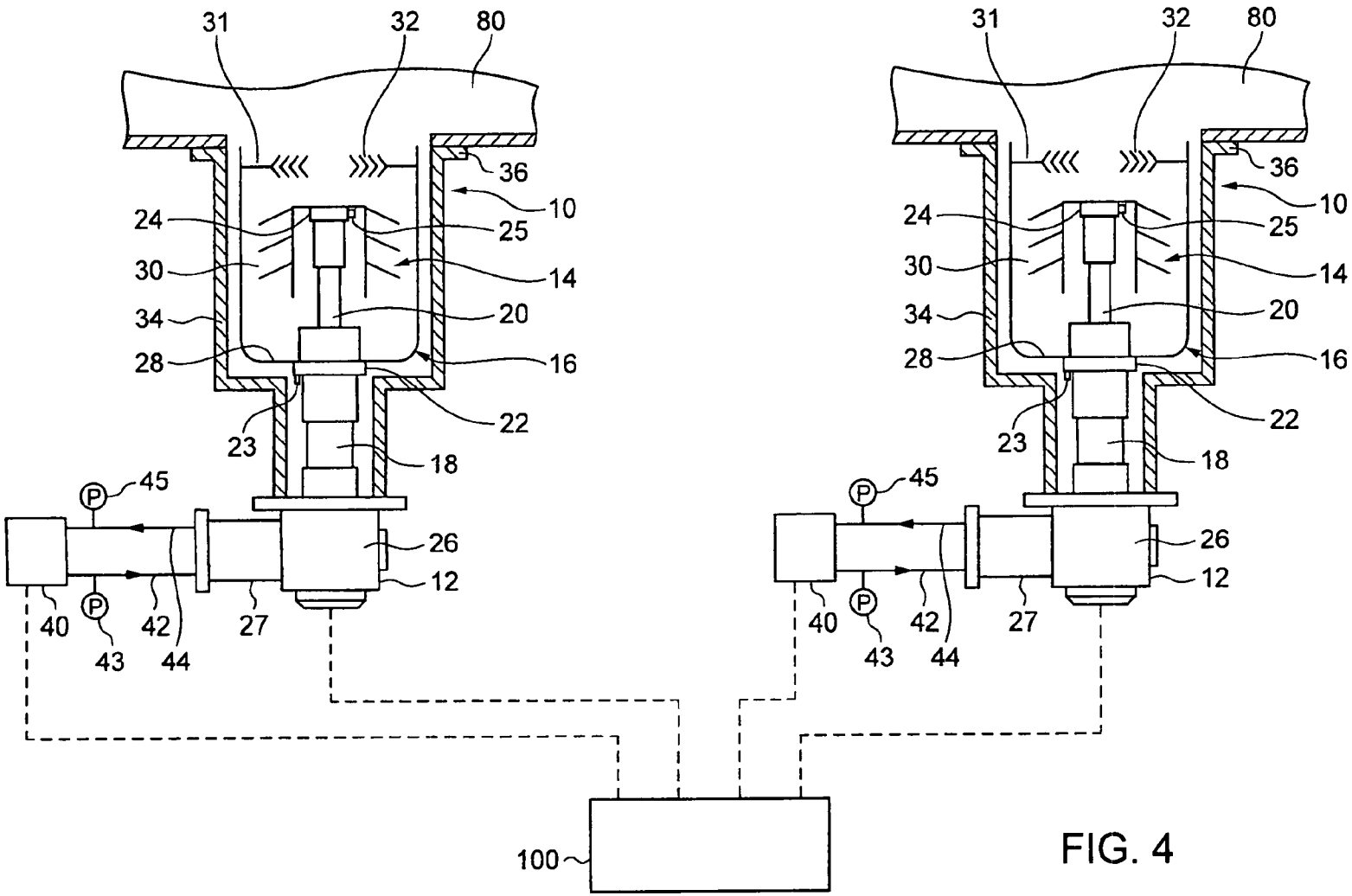
FIG. 4 is a schematic view illustrating a vacuum evacuation system according to an embodiment of the present invention provided with a plurality of refrigerators and a plurality of cyropanels.

In FIGS. 1 and 2, a vacuum evacuation system provided with each one of the cryopump 10 and the compressor 40 is illustrated; however, a vacuum evacuation system provided with a plurality of the cryopumps 10 and a plurality of the compressors 40, respectively, may also be configured. To attain such system, the CP controller 100 may be configured such that a plurality of the cryopumps 10 and a plurality of the compressors 40 can be connected thereto, as shown in FIG. 4.

To the CP controller 100, are connected the first temperature sensor 23 for measuring a temperature of the first cooling stage of the refrigerator 12 and the second temperature sensor 25 for measuring a temperature of the second cooling stage thereof. The first temperature sensor 23 periodically measures a temperature of the first cooling stage 22 to output a signal indicating the measured temperature to the CP controller 100. The second temperature sensor 25 periodically measures a temperature of the second cooling stage 24 to output a signal indicating the measured temperature to the CP controller 100. The measured values obtained by the first temperature sensor 23 and the second temperature sensor 25 are inputted to the CP controller 100 at predetermined intervals and stored in a predetermined storage area of the CP controller 100.

To the CP controller 100, are connected a first pressure sensor 43 used for measuring an operating gas pressure on the discharge side, i.e., on the high pressure side of the compressor 40, and a second pressure sensor 45 used for measuring an operating gas pressure on the inhale side, i.e., on the low pressure side of thereof. The first pressure sensor 43 periodically measures, for example, a pressure in the high pressure piping 42 to output a signal indicating the measured pressure to the CP controller 100. The second pressure sensor 45 periodically measures, for example, a pressure in the low pressure piping 44 to output a signal indicating the measured pressure to the CP controller 100. The measured values obtained by the first pressure sensor 43 and the second pressure sensor 45 are inputted to the CP controller 100 at predetermined intervals and stored in a predetermined storage area of the CP controller 100.

The CP controller 100 is connected to a refrigerator frequency converter 50 so as to be operable to communicate therewith. The refrigerator frequency converter 50 and the refrigerator motor 26 are connected to each other so as to be operable to communicate with each other. The CP controller 100 transmits a control command to the refrigerator frequency converter 50. The refrigerator frequency converter 50 is configured to include a refrigerator inverter 52. The refrigerator frequency converter 50 is supplied with electric power with the specified voltage and frequency from a refrigerator power supply 54, and supplies the electric power to the refrigerator motor 26 after adjusting the voltage and frequency of the supplied electric power based on the control command issued by the CP controller 100.

The CP controller 100 is connected to a compressor frequency converter 56 so as to be operable to communicate therewith. The compressor frequency converter 56 and a compressor motor 60 are connected to each other so as to be operable to communicate with other. The CP controller 100 transmits a control command to the compressor frequency converter 56. The compressor frequency converter 56 is configured to include a compressor inverter 58. The compressor frequency converter 56 is supplied with electric power with the specified voltage and frequency from a compressor power supply 62, and supplies the electric power to the compressor motor 60 after adjusting the voltage and frequency of the supplied electric power based on the control command transmitted by the CP controller 100. In the embodiment illustrated in FIG. 2, the refrigerator power supply 54 and the compressor power supply 62 are provided separately for each of the refrigerator 12 and the compressor 40; however, a common power supply between the refrigerator 12 and the compressor 40 may be provided.

The CP controller 100 controls the refrigerator 12 based on a temperature of the cryopanel. The CP controller 100 issues the operation command to the refrigerator 12 such that a temperature of the cryopanel follows the target temperature. For example, the CP controller 100 controls an operating frequency of the refrigerator motor 26 by performing feedback control so as to minimize the deviation between the target temperature of the cryopanel at the first stage and the measured temperature obtained by the first temperature sensor 23. The target temperature of the cryopanel at the first stage is determined as a specification, for example, in accordance with a process carried out in the vacuum chamber 80. In this case, the second cooling stage 24 and the panel assembly 14 of the refrigerator 12 are cooled to a temperature determined by the specification of the refrigerator 12 and a heat load from outside The CP controller 100 determines an operating frequency of the refrigerator motor 26 (e.g., rotational speed of the motor) such that the temperature of the cryopanel at the first stage follows the target temperature, and outputs a command value for the motor operating frequency to the refrigerator inverter 52. The CP controller 100 may control an operating frequency of the refrigerator motor 26 such that the temperature of the cryopanel at the second stage follows the target temperature.

Thereby, if the measured temperature obtained by the first temperature sensor 23 is higher than the target temperature, the CP controller 100 outputs a command value to the refrigerator frequency converter 50 so as to increase the operating frequency of the refrigerator motor 26. In response to the increase in the motor operating frequency, the heat cycle frequency in the refrigerator 12 is increased, allowing the first cooling stage 22 of the refrigerator 12 to be cooled toward the target temperature. In contrast, if the measured temperature obtained by the first temperature sensor 23 is lower than the target temperature, the operating cycle of the refrigerator motor 26 is decreased, allowing the first cooling stage 22 of the refrigerator 12 to be heated toward the target temperature.

The target temperature of the first cooling stage 22 is usually set to a constant value. Therefore, the CP controller 100 outputs, when a heat load on the cryopump 10 is increased, a command value so as to increase the operating frequency of the refrigerator motor 26, while outputs, when a heat load on the cryopump 10 is decreased, a command value so as to decrease the operating frequency thereof. The target temperature may be arbitrarily varied, for example, the target temperature of the cryopanel may be sequentially set so as to attain a target ambient pressure in the volume to be evacuated.

In a typical cryopump, the heat cycle frequency is always maintained at a constant value. The heat cycle frequency is set so as to operate the cryopump with a relatively larger frequency such that rapid cooling from room temperature to the temperature at which the pump operates, can be attained. If a heat load from outside is small, the temperature of the cryopanel is adjusted by heating with a heater, causing consumed electric power to be large. In contrast, in the present embodiment, the heat cycle frequency is controlled in accordance with a heat load on the cryopump 10, and hence a cryopump excellent in energy saving can be realized. Further, there is no need for providing a heater, which also contributes to reduction of the consumed power.

The CP controller 100 controls the frequency of the compression cycle executed in the compressor 40 so as to maintain a differential pressure (hereinafter, sometimes referred to as a compressor differential pressure) between the pressures at the inlet port and the outlet port of the compressor 40, at the target pressure. For example, the CP controller 100 controls the compression cycle frequency by performing feedback control so as to maintain the differential pressure between the pressures at the inlet port and the outlet port of the compressor 40, at a constant value. Specifically, the CP controller 100 determines the compressor differential pressure from the measured values obtained by the first pressure sensor 43 and the second pressure sensor 45. The CP controller 100 determines an operating frequency of the compressor motor 60 (e.g., rotational speed of the motor) such that the compressor differential pressure is to be equal to the target value, and outputs a command value for the motor operating frequency to the compressor frequency converter 56.

With such a constant differential pressure control method, consumed power can be further reduced. If heat loads on the cryopump 10 and the refrigerator 12 are small, the heat cycle frequency in the refrigerator 12 is small due to the aforementioned temperature control of the cryopanel. Then, a flow rate of the operating gas required in the refrigerator 12 becomes small, therefore the differential pressure between the pressures at the inlet port and the outlet port of the compressor 40 will become large. In the embodiment, however, the operating frequency of the compressor motor 60 is controlled so as to maintain the compressor differential pressure at a constant value, allowing the compression cycle frequency to be adjusted. Therefore, an operating frequency of the compressor motor 60 becomes small in this case. Accordingly, consumed power can be more reduced as compared to the case where the compression cycle is always maintained at a constant value like a typical cryopump.

On the other hand, if a heat load on the cryopump 10 becomes large, the operating frequency and the compression cycle frequency of the compressor motor 60 are increased so as to maintain the compressor differential pressure at a constant value. Hence, a flow rate of the operating gas flowing into the refrigerator 12 can be sufficiently secured, allowing an error between a cryopanel temperature and the target temperature, occurring due to the increase in the heat load, to be suppressed to a minimum.

In the present embodiment, the CP controller 100 further executes diagnostic processing of the cryopump 10. The CP controller 100 monitors, for example, either a temperature of the first stage cryopanel or a temperature of the second stage cryopanel, which is not the control target. Then, the CP controller 100 may determine whether the cryopump 10 undergoes performance degradation or failure based on a magnitude relationship between the monitored temperature and a determination reference temperature set in advance. If the diagnostic processing using the temperature is employed in conjunction with the aforementioned heat cycle frequency variable control method, the CP controller 100 may determine that the cryopump 10 undergoes performance degradation or failure when, for example, the measured temperature obtained by the second temperature sensor 25 is higher than the determination reference temperature, by comparing the measured temperature to the determination reference temperature.

In this case, the determination reference temperature may be set to a temperature lower than the process critical temperature specified as the specification dependent on the process carried out in the volume to be evacuated. The process critical temperature is set as an upper limit of the temperature of the cryopanel, in which it is ensured that the process is normally carried out. When the temperature, monitored for diagnosis, exceeds the determination reference temperature, the CP controller 100 may determine that the cryopump 10 undergoes performance degradation; and when the monitored temperature exceeds the process critical temperature, the CP controller 100 may determine that the cryopunp 10 undergoes failure. The CP controller 100 may recommend, when determining that the cryopump undergoes performance degradation, maintenance of the cryopump 10, while output, when determining that the cryopump undergoes failure, a strong warning requesting the cryopump 10 to be subjected to maintenance or repair.

The diagnostic processing using a temperature has an advantage that it can be realized with a simple control algorithm. However, it is needed that, when operating normally, the temperatures of the second stage cryopanel and the second cooling stage 24 are maintained within relatively narrow ranges; hence, the temperature of the cryopanel may reach the process critical temperature in a very short time after reaching the determination reference temperature. When operating normally, the temperature of the second stage cryopanel is set to a temperature of, for example, about 10 K or about 15 K. The process critical temperature is set to a temperature of, for example, about 15 K or 20 K.

A user who appreciates the display recommending maintenance usually adjusts a product manufacturing schedule by incorporating a maintenance timing into the original schedule such that the influence exerted by the maintenance on the schedule is to be as minor as possible. However, if the temperature of the cryopanel reaches the process critical temperature in a very short time after the maintenance recommendation is displayed at the time when the temperature reaches the determination reference temperature for maintenance, the maintenance timing cannot be realized as desired because the maintenance should be carried out immediately thereafter.

Therefore, in the present embodiment, the CP controller 100 may determine whether the cryopump 10 undergoes performance degradation or failure based on an operating parameter that permits a greater variation range or variation rate as compared to the temperature of the cryopanel. Alternatively, the CP controller 100 may determine whether the cryopump 10 undergoes performance degradation or failure based on an operating parameter that varies prior to the increase in the temperature of the cryopump 10 due to performance degradation. The CP controller 100 may also take, for example, the command value or the measured value for the operating frequency of the refrigerator motor 26, as the operating parameter for determination.

In the present embodiment, the operating frequency of the refrigerator motor 26 is, when operating normally, approximately 40 Hz, and an upper limit thereof is set to, for example, 95 Hz. According to the aforementioned heat cycle frequency variable control method, the operating frequency of the refrigerator motor 26 is to be increased so as to suppress an increase in the temperature of the cryopanel due to performance degradation. By diagnosing with the use of a parameter permitting a greater variation, a period between detection of performance degradation and failure of the cryopump can be made longer as compared to the determination made based on the temperature of the cryopanel. Accordingly, an execution timing of the maintenance processing can be set in a more flexible manner, and hence the influence on the user's product manufacturing schedule can be suppressed so as to be minor. In addition, the diagnostic processing based on an operating parameter may be used in conjunction with the aforementioned diagnostic processing based on the temperature, or be executed instead of the processing.

According to the process a user carries out, there is a possibility that the cryopump 10 may be temporarily subjected to a large heat load. In this case, the temperature of the cryopanel tends to be increased, and in response to that the operating parameter of the cryopump 10 also tends to be increased. Therefore, there are sometimes the cases where it is not necessarily easy to distinguish normality of the cryopump 10 from failure thereof based on the magnitude relationship between the operating parameter of the cryopunp 10 and the threshold value for determination.

Hence, in the present embodiment, the CP controller 100 estimates whether the refrigerator 12 outputs a refrigerating capacity corresponding to the operation command value issued to the cryopump 10. The CP controller 100 determines whether the cryopump 10 undergoes performance degradation or failure based on the estimation result. Alternatively, the CP controller 100 may determine whether the cryopump 10 undergoes performance degradation or failure by combining the aforementioned diagnostic processing using the operating parameter with the estimation result on the refrigerating capacity.

Figure 3:
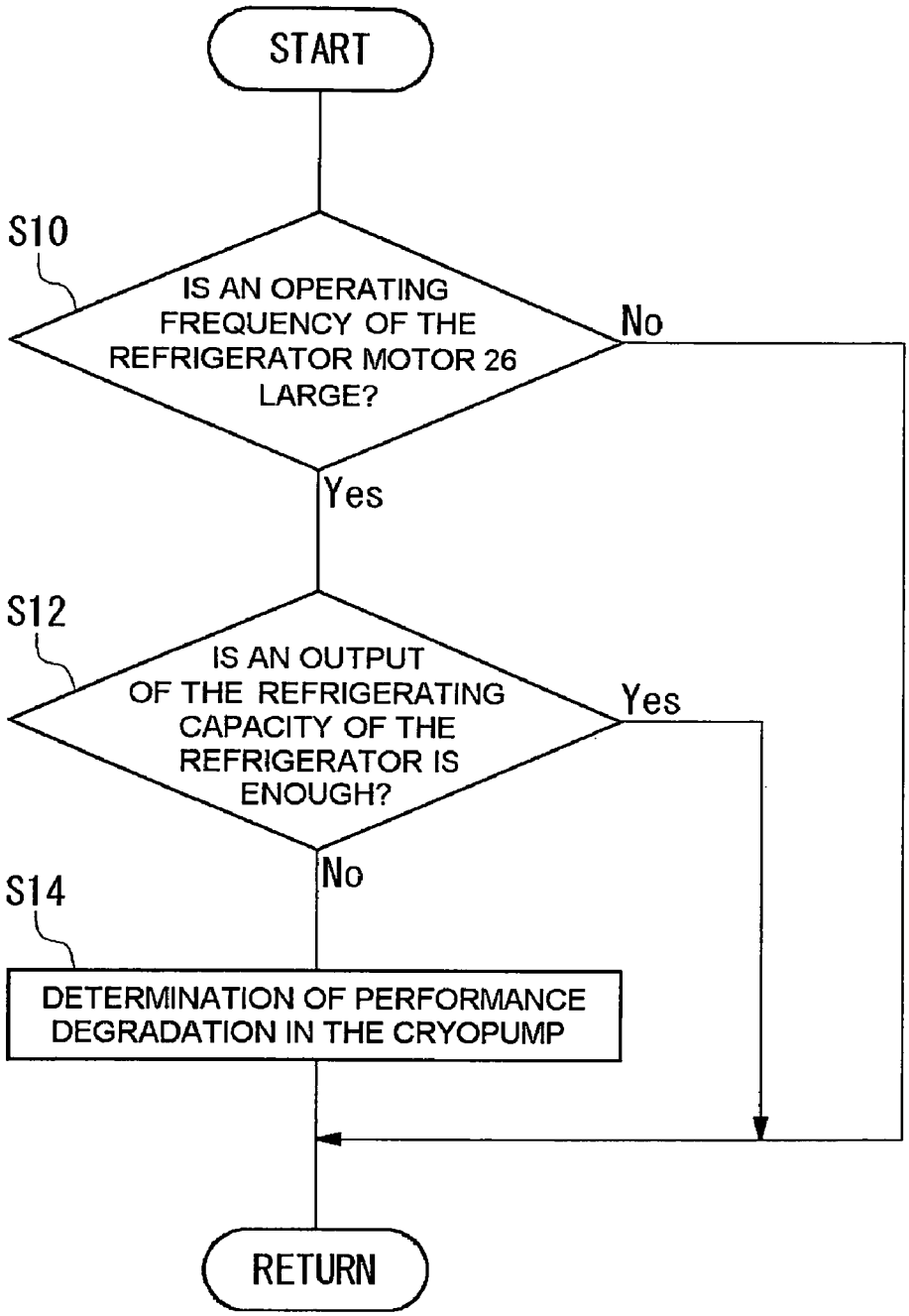
FIG. 3 is a flowchart for illustrating an example of the diagnostic processing according to an embodiment of the present invention.

FIG. 3 is a flowchart for illustrating an example of the diagnostic processing according to the present embodiment. The processing illustrated in FIG. 3 is repeatedly executed by the CP controller 100 with a predetermined period during the evacuation processing of the cryopump 10.

The CP controller 100 at first determines whether the operating frequency of the refrigerator motor 26 is larger than the reference value (S10). Specifically, the CP controller 100 determines whether, for example, the operating frequency of the refrigerator motor 26 exceeds the reference frequency, a threshold value for determination. In this case, the CP controller 100 determines whether the command value for the operating frequency issued to the refrigerator motor 26, exceeds the reference frequency. There is no need for measuring an operating frequency by determining based on the command value. Hence, a sensor for measuring the operating frequency is not needed, allowing the apparatus to be simply configured.

If the operating frequency of the refrigerator motor 26 exceeds the reference value (S10/Yes), the CP controller 100 determines whether an output of the refrigerating capacity by the refrigerator 12 is enough (S12). That is, the CP controller 100 determines whether the refrigerating capacity corresponding to the operation command issued to the refrigerator motor 26 is outputted. Specifically, the CP controller 100 determines whether, for example, the operating frequency of the compressor motor 60 exceeds the threshold value for determination. The threshold value for determination is set, for example, in response to the command value for the operating frequency of the refrigerator motor 26. For example, the threshold value for determination is set so as to be larger as the command value for the operating frequency of the refrigerator motor 26 is larger. For example, a map representing the relationship between the command value for the operating frequency of the refrigerator motor 26 and the operating frequency of the compressor motor 60 is, when operating normally, stored in advance in the CP controller 100. The CP controller 100 may determine whether the refrigerating capacity corresponding to the operation command issued to the refrigerator motor 26, is outputted based on the map.

If the operating frequency of the compressor motor 60 does not reach the threshold value for determination (S12/No), the CP controller 100 determines that the cryopump 10 undergoes performance degradation (S14). In the present embodiment, the differential pressure between the pressures at the inlet port and the outlet ports of the compressor 40 is controlled so as to be maintained at a constant value, and the operating frequency of the compressor motor 60 is controlled so as to be at a value corresponding to the flow rate of the operating gas required by the refrigerator 12. That is, the fact that the operating frequency of the compressor motor 60 is small means that the refrigerator 12 does not require so much of the operating gas. Therefore, if the operating frequency of the compressor motor 60 does not reach the threshold value for determination, it can be determined that an actual heat cycle frequency in the refrigerator 12 is at a lower level than the command value. Thus, whether the refrigerating capacity corresponding to the operation command issued to the refrigerator 12 is outputted can be estimated based on the flow rate of the operating gas.

If the operating frequency of the compressor motor 60 exceeds the threshold value for determination (S12/Yes), the CP controller 100 ends the diagnostic processing according to the embodiment. It is because it can be estimated in this case that the refrigerating capacity of the refrigerator 12 is normally outputted at the level corresponding to the command value.

If the operating frequency of the refrigerator motor 26 does not reach the reference value (S10/No), the CP controller 100 ends the diagnostic processing according to the embodiment. It is because the refrigerating capacity required for the refrigerator 12 is not so large in this case. When the refrigerating capacity required is not large, the influence exerted by the performance degradation is minor even if such degradation occurs. Also, if the operating frequency of the refrigerator motor 26 does not reach the reference value, the CP controller 100 may execute the aforementioned processing for determining performance degradation by comparing the operating frequency of the compressor motor 60 to the threshold value for determination.

The CP controller 100 may outputs a warning that recommends maintenance of the cryopump 10 as well as determining that the cryopump 10 undergoes performance degradation. Further, the CP controller 100 may additionally set a threshold value for determining failure, which is larger than the aforementioned threshold value for determining performance degradation, and determine that the cryopump 10 undergoes failure when the operating frequency of the compressor motor 60 exceeds the threshold value for determining failure.

Failure modes of the cryopump 10 include, for example, failure in the drive system of the cryopump 10 used in the refrigerator motor 26 and the like. In this case, the rotational speed outputted by the drive system is decreased, causing the actual operating frequency of the motor, i.e., the heat cycle frequency to be lower than the command value for the operating frequency issued to the refrigerator motor 26. As other failure modes, for example, performance degradation due to time degradation of a non-movable portion such as a sealing member or a cold storage material within the refrigerator 12, can be cited.

In the aforementioned diagnostic processing, performance degradation or failure in the drive system of the cryopump 10, such as the refrigerator motor 26, etc., can be mainly detected. Therefore, the CP controller 100 may specify a failure mode as performance degradation or failure in the drive system of the cryopump 10 as well as determining that the cryopump 10 undergoes performance degradation in the aforementioned diagnostic processing.

The operation of the cryopump 10 with the aforementioned configuration will be described below. In operating the cryopump 10, the inside of the vacuum chamber 80 is evacuated to the degree of approximately 1 Pa by using other appropriate roughing pump prior to its operation. Subsequently the cryopump 10 is operated. The first cooling stage 22 and the second cooling stage 24 are cooled by driving the refrigerator 12, allowing the heat shield 16, the baffle 32 and the panel assembly 14, which are thermally connected to the stages, also to be cooled.

The cooled baffle 32 cools gas molecules flying toward the inside of the cryopump 10 from the vacuum chamber 80 to condense a gas (e.g., moisture), vapor pressure of which is sufficiently low at the cooling temperature, on its surface and pump the gas. A gas, vapor pressure of which is not sufficiently low at the cooling temperature of the baffle 32, passes through the baffle 32 to enter the inside of the heat shield 16. Among the gas molecules thus entering the inside, a gas (e.g., argon), vapor pressure of which is sufficiently low at the cooling temperature of the panel assembly 14, is condensed on the surface of the structure 14 to be pumped. A gas (e.g., hydrogen), vapor pressure of which is not sufficiently low at the cooling temperature, is adsorbed by an adsorbent, which is attached to the surface of the panel assembly 14 and cooled, and pumped. Thus, the cryopump 10 can enhance the degree of vacuum inside the vacuum chamber 80 to a required level.

The CP controller 100 controls the refrigerator 12 so as to cool the heat shield 16 and the baffle 32 to a predetermined target temperature. To attain this, the CP controller 100 determines a command value for the operating frequency of the refrigerator motor 26 so as to maintain the measured temperature obtained by the first temperature sensor 23, at the target temperature. If the command value for the operating frequency of the refrigerator motor 26 exceeds the reference value, the CP controller 100 determines whether the operating frequency of the compressor motor 60 exceeds the threshold value for determination. Thereby, the CP controller 100 determines whether the refrigerating capacity corresponding to the determined command value for the operating frequency of the refrigerator motor 26, is outputted.

If the refrigerating capacity required is low, the influence exerted by performance degradation is minor even if such degradation occurs. On the other hand, if the cryopump undergoes performance degradation or failure, a divergence between an actual refrigerating capacity and the estimation result on the refrigerating capacity becomes larger as the refrigerating capacity required is larger. Therefore, occurrence of performance degradation or failure can be accurately diagnosed by combining the operation command value issued to the refrigerator with the estimation result on the refrigerating capacity. Further, the occurrence of the performance degradation or failure can be diagnosed in real time.

In the aforementioned embodiments, occurrence of performance degradation or failure is determined in the vacuum evacuation system with a single cryopump 10; however, occurrence thereof can also be determined in the vacuum evacuation system with a plurality of cryopumps. Further, it can be specified, among the plurality of cryopumps, which one undergoes performance degradation or failure.

For example, the CP controller 100 determines whether the operation command value issued to each of the plurality of refrigerators 12 exceeds the reference value. The CP controller 100 estimates the flow rate of the operating gas discharged from the compressor 40 based on the compression cycle frequency in the compressor 40. If the flow rate thus estimated is below the threshold value for determination, the CP controller 100 determines that any one of the refrigerators 12, operation command values issued to which exceed the reference value, undergoes performance degradation or failure.

In this case, it can be considered that the flow rate of the operating gas becomes below the threshold value for determination due to the influence exerted by any one of the refrigerators 12, operation command values issued to which exceed the reference value. Therefore, it can be specified that any one of the refrigerators 12, operation command values issued to which exceed the reference value, undergoes performance degradation or failure. If there is a single refrigerator 12, operation command value issued to which exceeds the reference value, it can be specified that the cryopump 10 provided with the refrigerator 12 undergoes performance degradation or failure. If there are a plurality of refrigerators 12, operation command values issued to which exceed the reference value, it can be specified that any one of the cryopumps 10 provided with the refrigerators 12 undergoes performance degradation or failure.

In the present embodiment, the CP controller 100 controls both of the cryopump 10 and the compressor 40, but the embodiment should not be limited thereto. For example, either of the cryopump 10 and the compressor 40 may be provided with a control unit. In this case, a cryopump control unit for controlling the cryopump 10 and a compressor control unit for controlling the compressor 40 are provided. The cryopump control unit and the compressor control unit control the cryopump 10 and the compressor 40 independently from each other. In this case, the cryopump control unit may monitor the state of the compressor 40 (e.g., differential pressure exerted on the compressor 40, rotational speed of the compressor motor 60, etc.) while the compressor control unit monitor the state of the cryopump 10 (e.g., temperature of the cryopanel, rotational speed of the refrigerator motor 26, etc.). In this case, the aforementioned diagnostic processing may be executed by the cryopump control unit or the compressor control unit.

What is claimed is:

1. A cryopump comprising:

a refrigerator that generates a cold state by a heat cycle in which an operating gas inhaled inside is expanded and discharged;

a cryopanel thermally connected to the refrigerator so as to be cooled to a target temperature; and a control unit that determines a command value for a heat cycle frequency such that a temperature of the cryopanel follows the target temperature, and provides the command value to the refrigerator, wherein the control unit estimates whether the refrigerator outputs a refrigerating capacity corresponding to the command value for the frequency based on a flow rate of the operating gas.

2. The cryopump according to claim 1, wherein, when it is estimated that the refrigerator does not output the refrigerating capacity corresponding to the command value for the frequency and when the command value for the frequency exceeds a reference value, the control unit determines that the cryopump undergoes performance degradation.

3. The cryopump according to claim 1 further comprising a compressor that executes a compression cycle in which the operating gas discharged from the refrigerator is compressed to a high pressure and delivered into the refrigerator, wherein the control unit controls a frequency of the compression cycle so as to maintain a differential pressure between a pressure of the operating gas discharged from the refrigerator and a pressure thereof delivered into the refrigerator, at a constant value, and wherein the control unit estimates whether the refrigerator outputs the refrigerating capacity corresponding to the command value for the heat cycle frequency based on the frequency of the compression cycle.

4. A vacuum evacuation system comprising:

a plurality of refrigerators, each of which generates a cold state by a heat cycle in which an operating gas inhaled inside is expanded and discharged;

a plurality of cryopanels, each of which is thermally connected to a respective refrigerator so as to be cooled to a target temperature;

a compressor that is provided in common for the plurality of refrigerators and executes a compression cycle in which the operating gas discharged from each refrigerator is compressed to a high pressure and delivered into the refrigerator; and a control unit that determines a command value for a heat cycle frequency such that a temperature of a respective cryopanel follow the target temperature and provides the value to the respective refrigerator, and that controls a frequency of the compression cycle so as to maintain a differential pressure between pressures at an inlet port and an outlet port of the compressor, at a constant value, wherein the control unit determines whether the command value for the heat cycle frequency issued to the respective refrigerator exceeds a reference value, and estimates a flow rate of the operating gas discharged from the compressor based on the frequency of the compression cycle, and wherein, when the estimated flow rate is below a threshold value for determination, the control unit determines that any one of the refrigerators, the command value for the frequency issued to which exceed a reference value, undergoes performance degradation.

5. A method for diagnosing a cryopump, comprising:

determining whether an operation command exceeds a reference value, the operation command issued to a refrigerator such that a temperature of a cryopanel thermally connected to the refrigerator so as to be cooled follows a target temperature;

estimating whether the refrigerator outputs a refrigerating capacity corresponding to the operation command; and determining, when it is determined that the operation command exceeds the reference value and it is estimated that the refrigerator does not output the refrigerating capacity corresponding to the operation command, that the cryopump undergoes performance degradation.

6. A method for diagnosing a vacuum evacuation system, the system including a plurality of refrigerators, each of which generates a cold state by a heat cycle in which an operating gas inhaled inside is expanded and discharged; a plurality of cryopanels, each of which is thermally connected to a respective refrigerator so as to be cooled to a target temperature;

and a compressor that is provided in common for the plurality of refrigerators and executes a compression cycle in which the operating gas discharged from each refrigerator is compressed to a high pressure and delivered into the refrigerator; the system is configured to determine a command value for a heat cycle frequency such that a temperature of a respective cryopanel follows the target temperature and to provide the value to the respective refrigerator, and controls a frequency of the compression cycle so as to maintain a differential pressure between pressures at an inlet port and an outlet port of the compressor, at a constant value, comprising:

determining whether the command value for the heat cycle frequency issued to the respective refrigerator exceeds a reference value, and estimating a flow rate of the operating gas discharged from the compressor based on the frequency of the compression cycle; and determining, when the estimated flow rate is below a threshold value for determination, that anyone of the refrigerators, the command value for the frequency issued to which exceed a reference value, undergoes performance degradation.

7. A vacuum evacuation system comprising:

a refrigerator for cooling a cryopanel that generates a cold state by expanding and discharging an operating gas inhaled inside;

a compressor that compresses the operating gas discharged from the refrigerator to a high pressure and delivers the gas into the refrigerator; and a control unit that controls the refrigerator such that a temperature of the cryopanel follows a target temperature, and controls the compressor such that a differential pressure between pressures at an inlet port and an outlet port of the compressor is maintained at a target pressure, wherein the control unit determines whether the refrigerator undergoes performance degradation or failure based on an operation parameter of the refrigerator and a flow rate of the operating gas.

8. A method for diagnosing a vacuum evacuation system, the system including a refrigerator for cooling a cryopanel that generates a cold state by expanding and discharging an operating gas inhaled inside; and a compressor that compresses the operating gas discharged from the refrigerator to a high pressure and delivers the gas into the refrigerator, the system is configured to control the refrigerator such that a temperature of the cryopanel follows a target temperature, and to control the compressor such that a differential pressure between pressures at an inlet port and an outlet port of the compressor is maintained at a target pressure, comprising:

determining whether the refrigerator undergoes performance degradation or failure based on an operation parameter of the refrigerator and a flow rate of the operating gas.

9. A controller for controlling a refrigerator for cooling a cryopanel and a compressor associated with the refrigerator, comprising:

a control unit that controls the refrigerator such that a temperature of the cryopanel follows a target temperature, and controls the compressor such that a differential pressure between pressures at an inlet port and an outlet port of the compressor is maintained at a target pressure, wherein the control unit determines whether the refrigerator undergoes performance degradation or failure based on an operation parameter of the refrigerator and a flow rate of the operating gas.

* * * * *